US007330679B2

(12) United States Patent
Kweon

(10) Patent No.: US 7,330,679 B2
(45) Date of Patent: Feb. 12, 2008

(54) IMAGE FORMING APPARATUS IN WHICH A USER MAY SEPARATE A DEVELOPMENT CARTRIDGE FROM THE IMAGE FORMING APPARATUS

(75) Inventor: Dae-seob Kweon, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 133 days.

(21) Appl. No.: 11/290,601

(22) Filed: Dec. 1, 2005

(65) Prior Publication Data

US 2006/0159486 A1 Jul. 20, 2006

(30) Foreign Application Priority Data

Jan. 19, 2005 (KR) ..... 10-2005-0004989

(51) Int. Cl.
*G03G 21/16* (2006.01)
*G03G 15/00* (2006.01)

(52) U.S. Cl. ..... 399/111; 399/110

(58) Field of Classification Search ..... 399/107, 399/110, 111, 112, 119, 125
See application file for complete search history.

(56) References Cited

U.S. PATENT DOCUMENTS 5,300,979 A * 4/1994 Tsukakoshi et al. ..... 399/111
5,444,515 A * 8/1995 Haneda et al. ..... 399/112
5,835,823 A * 11/1998 Damji et al. ..... 399/111
5,930,561 A * 7/1999 Hosokawa et al. ..... 399/111

FOREIGN PATENT DOCUMENTS

| | | |
|---|---|---|
| JP | 11-133745 | 5/1999 |
| JP | 2002-166573 | 6/2002 |
| JP | 2002-207408 | 7/2002 |
| JP | 2003-084646 | 3/2003 |

OTHER PUBLICATIONS

Japanese Office Action issued Apr. 25, 2006 in corresponding Japanese Patent Application No. 2005-4989.

* cited by examiner

*Primary Examiner*—Sandra L. Brase
(74) *Attorney, Agent, or Firm*—Stein, McEwen & Bui, LLP

(57) ABSTRACT

An image forming apparatus, including a main body frame, a cover which is pivotally coupled to the main body frame, to occupy and move between a first position at which the cover is closed and a second position at which the cover is open, and a development cartridge, which is detachably mounted to an inner portion of the main body frame, and a handle connected to the cover so as to move the development cartridge in the outside direction of the main body frame when the cover is moved from the first position to the second position.

21 Claims, 6 Drawing Sheets

IMAGE FORMING APPARATUS IN WHICH A USER MAY SEPARATE A DEVELOPMENT CARTRIDGE FROM THE IMAGE FORMING APPARATUS

CROSS-REFERENCE TO RELATED APPLICATIONS

This application claims the benefit of Korean Application No. 2005-4989, filed Jan. 19, 2005, in the Korean Intellectual Property Office, the disclosure of which is incorporated herein by reference.

BACKGROUND OF THE INVENTION

1. Field of the Invention

An aspect of the present invention relates to an image forming apparatus, and, more particularly, to an image forming apparatus in which a development cartridge is detachable.

2. Description of the Related Art

Generally, an image forming apparatus adopting an electro-photographic method, such as a laser beam printer, a digital copier and a multifunctional device scans a photosensitive medium with a laser beam, forms an electrostatic latent image, and applies a developer to the photosensitive medium on which the electrostatic latent image is formed, so as to form a visible image. During the image forming process, a printing medium is supplied from a paper feed cassette, and the visible image is transferred to the printing medium. Then, the printing medium is subject to a fixing process and is discharged to the outside of the image forming apparatus.

Meanwhile, since the photosensitive medium and a developer container to contain the developer each have a limited lifespan, each should be replaced after the developer is exhausted. Recently, the developer container has been made of a cartridge (hereinafter referred to as the "a development cartridge") in which the photosensitive medium and the developer container are integrally formed in order to facilitate replacement. Such a development cartridge is provided with a handle that the user may grip during handling thereof. Thus, the user may mount the development cartridge to an inner portion of the image forming apparatus or separate it from the inner portion of the image forming apparatus by gripping the handle.

Although there may be differences depending on the specification of products, in general, the development cartridge is deeply installed in the inner portion of the image forming apparatus which has a moving path in a "C" shape wherein the printing medium is moved from the paper feed cassette through the photosensitive medium and a fixing unit and discharged to the outside of the image forming apparatus. Thus, when the user separates the development cartridge from the image forming apparatus by gripping the handle portion of the development cartridge, the user may be inconvenienced in that the user is required to put his hand deeply into the inner portion of the image forming apparatus. In particular, according to the recent trend of miniaturization of image forming apparatuses, a space, in which the handle of the development cartridge that is mounted within the image forming apparatus is exposed, is small. Thus, the user may have difficulty in gripping the handle.

SUMMARY OF THE INVENTION

An aspect of the present invention provides an image forming apparatus wherein a user may relatively easily separate a development cartridge from the image forming apparatus.

An image forming apparatus according to this aspect of the present invention comprises a main body frame, a cover which is pivotally coupled to the main body frame, to occupy and move between a first position at which the cover is closed and a second position at which the cover is open, and a development cartridge, which is detachably mounted to an inner portion of the main body frame, and a handle connected to the cover so as to move the development cartridge in the outside direction of the main body frame when the cover is moved from the first position to the second position.

The handle has side portions of which one side portion is pivotally coupled to the development cartridge and the other side portion is formed with a connecting member. Further, the connecting member of the handle comprises a hook and the cover is formed with an engagement jaw for locking the hook. Also, the cover has a third position at which a locking of the hook of the handle with the engagement jaw is released between the first position and the second position. When the cover is positioned at the third position, a portion of the handle of the development cartridge is exposed to the outside of the main body frame.

The handle has a horizontal rib of which one end is adapted to be coupled to the development cartridge by the hinge axis, and a slant rib which is connected to the other end of the horizontal rib, formed to be slanted upwardly, and has a hook at an end, and a portion of the slant rib is exposed to the outside of the main body frame. Also, the development cartridge has one or more guide bosses which are projected and formed at both sides of the development cartridge, and a guide rail for guiding the guide bosses is formed in an inner portion of the main body frame.

The guide rail has a horizontal portion, and a slant portion, which is connected to the horizontal portion and slanted upwardly toward an inner portion of the main body frame. The slant rib of the handle is moved upwardly from the point at which at least one of the guide bosses pass over the slant portion and travel the horizontal portion.

Further, the third position at which the locking of the hook of the handle and the engagement jaw is released comprises a position at which at least one of the guide bosses travel the horizontal portion of the guide rail at a predetermined distance.

The hook has a leading edge portion of a round shape. Further, the engagement jaw has a slant surface which is adapted to contact with the leading edge portion and push the hook upwardly when the cover is moved from the first position to the second position, and a groove portion in which the hook is situated when the cover is positioned at the first position.

Additional and/or other aspects and advantages of the invention will be set forth in part in the description which follows and, in part, will be obvious from the description, or may be learned by practice of the invention.

BRIEF DESCRIPTION OF THE DRAWINGS

These and/or other aspects and advantages of the invention will become apparent and more readily appreciated from the following description of the embodiments, taken in conjunction with the accompanying drawings of which.

DETAILED DESCRIPTION OF THE EMBODIMENTS

Figure 1:
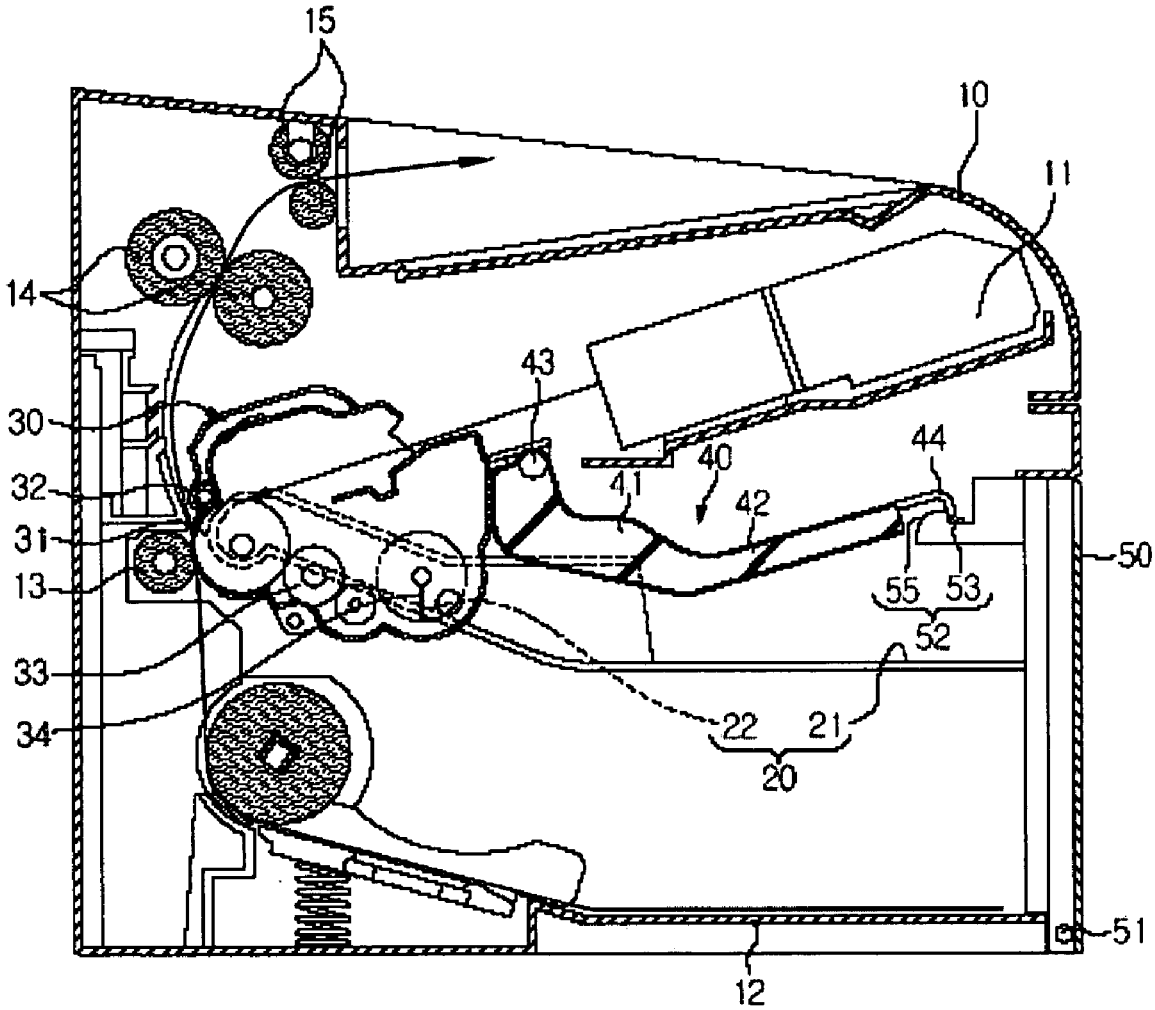
FIG. 1 is a view showing a construction of an image forming apparatus to which a development cartridge is mounted according to an embodiment of the present invention.

Reference will now be made in detail to the present embodiments of the present invention, examples of which are illustrated in the accompanying drawings, wherein like reference numerals refer to the like elements throughout. The embodiments are described below in order to explain the present invention by referring to the figures.

FIG. 1 is a view showing a construction of the image forming apparatus in which a development cartridge 30 according to an embodiment of the present invention is mounted within an inner portion of a main body frame 10.

As shown in the drawings, a laser scanning unit 11 scans a laser beam based on image information and forms an electrostatic latent image on a photosensitive drum 31 of the development cartridge 30 that is to be charged with a constant electric potential. A developing roller 33 applies a developer on the photosensitive drum 31 on which the electrostatic latent image is formed, and forms a visible image thereon. During such an image forming process, the printing medium supplied from a paper feed cassette 12 enters between the photosensitive drum 31 and a transfer roller 13. The transfer roller 13 transfers the visible image formed on the photosensitive drum 31 onto the printed medium. The printed medium on which the visible image was transferred passes over a fixing unit 14 to fix the image on the printed medium, and is discharged to the outside by a paper discharge roller 15. As shown, a paper moving path from a paper feed cassette 12 to the outside of the image forming apparatus has a "C" shaped path.

A guide rail 20 to guide a guide boss 38 (see FIG. 2) of the development cartridge is installed in the inner portion of the main body frame 10. The guide rail 20 has a horizontal portion 21 and a slant portion 22. The horizontal portion 21 is linearly extended toward the inner portion from one side of the main body frame 10 having the cover 50. The slant portion 22 is connected to the horizontal portion 21 and is slanted upwardly toward the inner portion of the main body frame 10.

Figure 2:
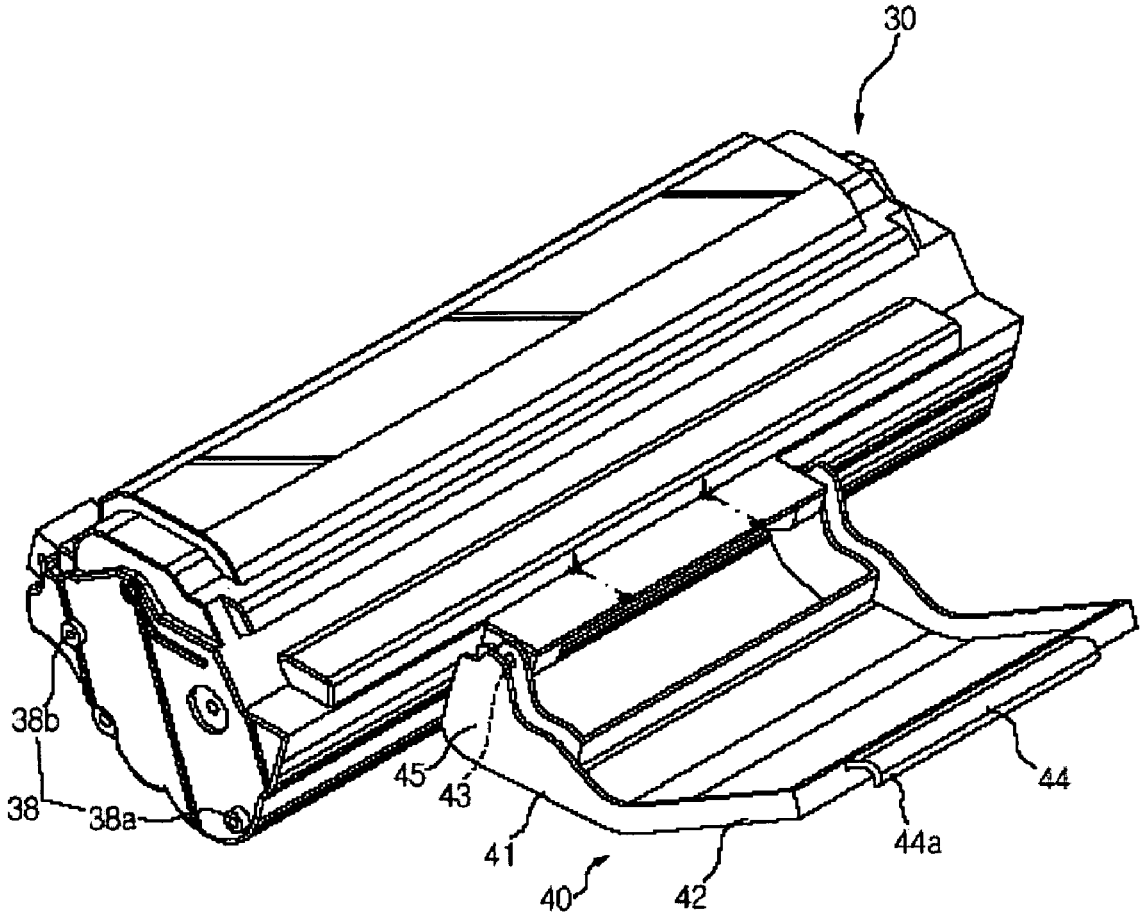
FIG. 2 is a perspective view of a development cartridge according to an embodiment of the present invention.

Referring to FIG. 1 and FIG. 2, the development cartridge 30 mounted in the inner portion of the main body frame 10 to perform the image forming operation includes the photosensitive drum 31 as the photosensitive medium therein, a charging roller 32 to charge the surface of the photosensitive drum 31 with a constant electrical potential, a developing roller 33 to apply a developer on the photosensitive drum 31 and to form a visible image thereon, and an agitator 34 to agitate the developer to prevent a solidification of the developer. Each of the components including the photosensitive drum 31 is received within a housing made of resin, forms a cartridge integrally, and is adapted to be detachably mounted within the main body frame 10.

The guide bosses 38 are positioned and projected at both sides of the development cartridge 30. A first guide boss **38*a* and a second guide boss 38*b* are formed on each side of the development cartridge 30, with the second guide boss 38*b* being formed higher than the first guide boss 38*a*. When the development cartridge 30 is mounted to the main body frame 10, the guide bosses 38 are moved along the guide rail 20 positioned within the main body frame 10. Consequently, the development cartridge 30 is slidably mounted within the main body frame 10**.

A handle 40 is pivotally coupled to the one side of the development cartridge 30 with a hinge axis 43. The handle 40 may have a plate shape such that a user may grip it relatively easily. However, it is understood that the handle 40 may have other shapes. The handle 40 includes a horizontal rib 41 and a slant rib 42, which is connected to the horizontal rib 41 and which is formed to be slanted upwardly.

One side of the horizontal rib 41 is constructed such that it is coupled to the development cartridge 30 with the hinge axis 43 so that the handle 40 can be freely rotated upwardly. A supporting portion 45 is formed to contact the development cartridge 30 below the hinge axis 43 whereby the handle 40 cannot be rotated downwardly. A coupling member is formed at the other side of the slant rib 42 to connect to a cover 50. In the present invention, the coupling member provides a way to couple the handle 40 with the cover 50, and a hook 44 is applied as the coupling member in the embodiment of the present invention. The hook 44 is adapted to be constrained in an engagement jaw 52 provided in the cover 50 as will be described below. As shown in the drawings, a leading edge portion **44*a* (see FIG. 3) of the hook 44** has a round shape.

Figure 4:
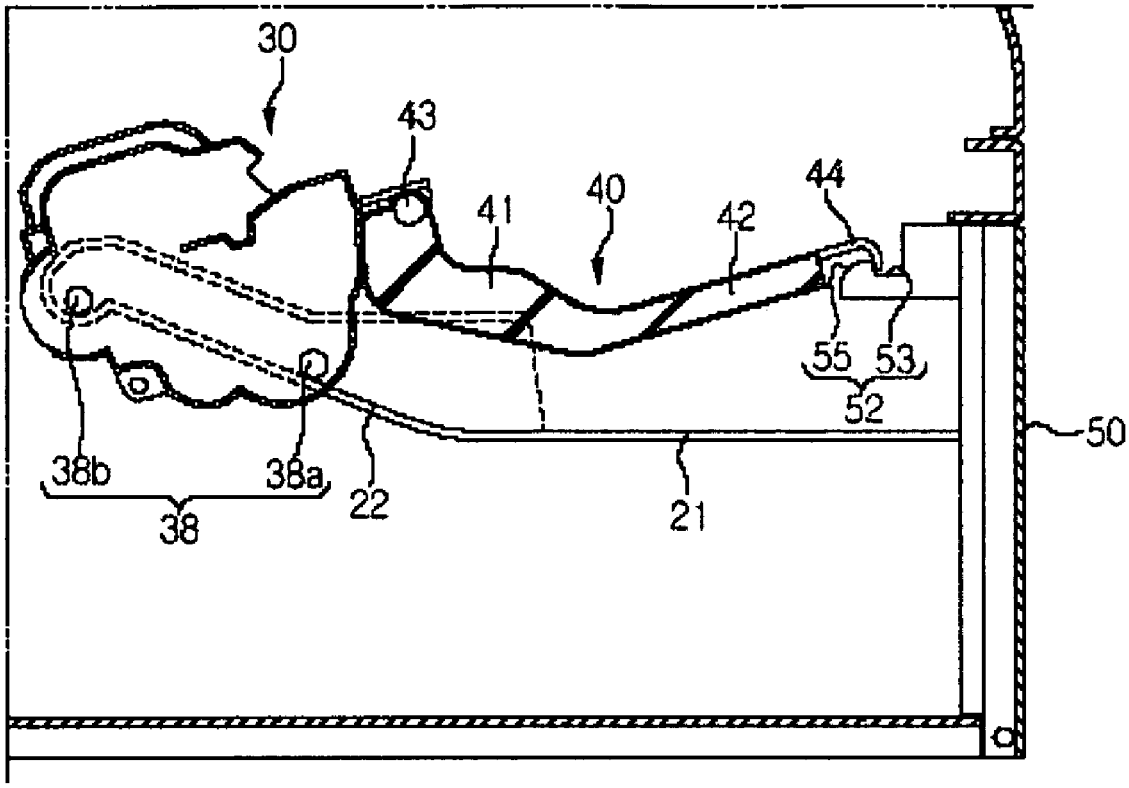
FIG. 4 is a partial side elevation of the image forming apparatus at a first position at which the cover is completely closed.

Referring to FIG. 1 and FIG. 4, the cover 50 is pivotally coupled to the main body frame 10 with a hinge axis 51.

The engagement jaw 52, provided to be connected to the handle 40 of the development cartridge 30, is installed in the inner side of the cover 50.

The engagement jaw 52 has a groove portion 53, at which the hook 44 of the handle 40 is received, and a slant surface 55 formed to have a certain predetermined inclination. As shown, under the condition that the cover 50 is closed, the hook 44 of the handle 40 remains in the condition that it is locked to the groove portion 53 of the engagement jaw 52.

In this way, the hook 44 of the handle 40 is locked to the engagement jaw 52, and if a user opens a cover 50, the development cartridge 30 is therefore pulled out of the main body frame 10 in connection with an opening operation of the cover 50.

The hook 44 of the handle 40 is adapted to be locked to a predetermined position, that is, a position that the handle 40 of the development cartridge 30 is exposed to the outside of the main body frame 10 so that a user can grip the handle 40 easily, not being locked to the engagement jaw 52 of the cover 50 until the cover 50 is completely opened. Also, at this point, the locking of the hook 44 of the handle 40 and the engagement jaw 52 of the cover 50 is released (see FIG. 5). Then, since the locking thereof is released, the hook 44 of the handle 40 and the engagement jaw 52 of the cover 50 are not contacted to each other.

An operation that the development cartridge 30 is mounted to the main body frame 10 of the image forming apparatus, and an operation that the development cartridge 30 is separated from the main body frame 10 will be described below.

Figure 3:
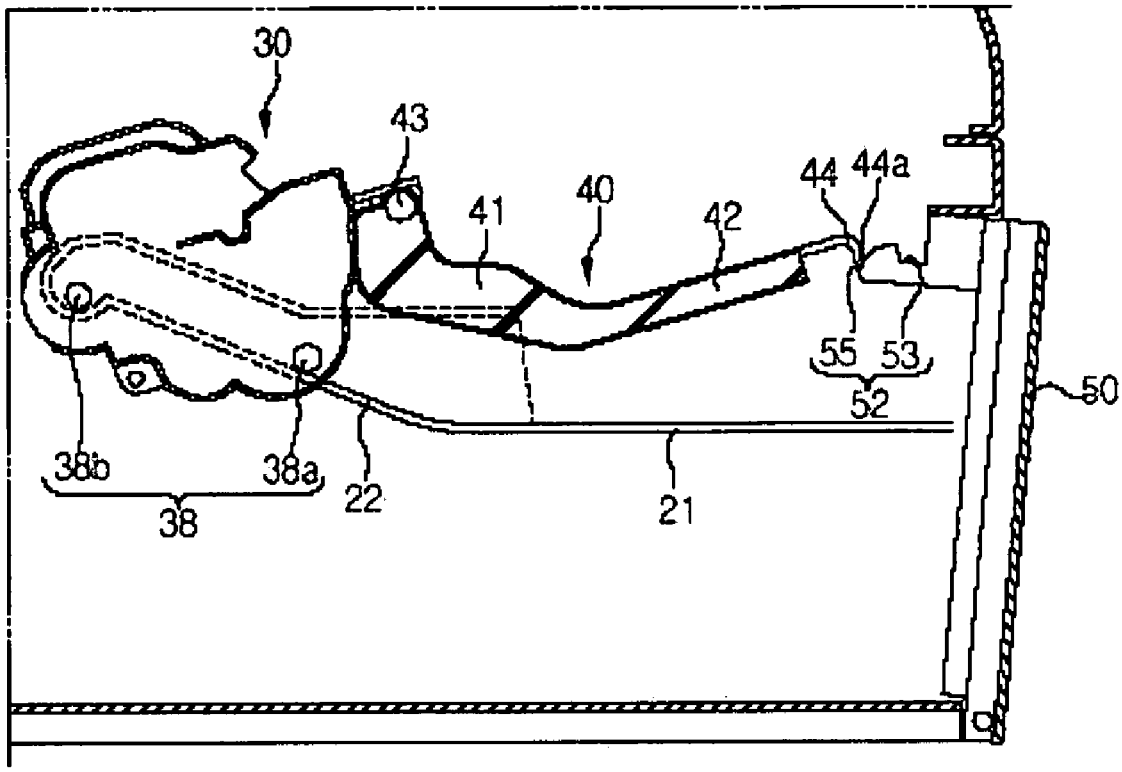
FIG. 3 is a partial side elevation of the image forming apparatus in which a cover is being closed.

First, when the development cartridge 30 is mounted to the inner portion of the main body frame 10, the user opens the cover 50 and inserts the development cartridge 30 into the inner portion of the main body frame 10 so as to guide the guide bosses 38 that are projected at right and left sides of the development cartridge 30 along the guide rail 20 that are provided within the main body frame 10. Then, the mounting operation is concluded by a closure of the cover 50. Here, as shown in FIG. 3, before the cover 50 is completely closed, the slant surface 55 of the engagement jaw 52 is contacted to the leading edge portion 44*a* of the hook 44. Meanwhile, since the surface of the leading edge portion 44*a* has a rounded shape and the slant surface 55 has also a slanted profile, if the cover is further closed, the slant surface 55 of the engagement jaw 52 will push the hook 44 upwardly. Here, since the handle 40 is coupled to the development cartridge 30 with the hinge axis 43, the handle 40 may be freely pivoted upwardly. If the cover 50 is completely closed, the leading edge portion 44*a* of the hook 44 will pass over the highest position of the slant surface 55, and then be situated into the groove portion 53 while descending as the rising height thereof.

Figure 5:
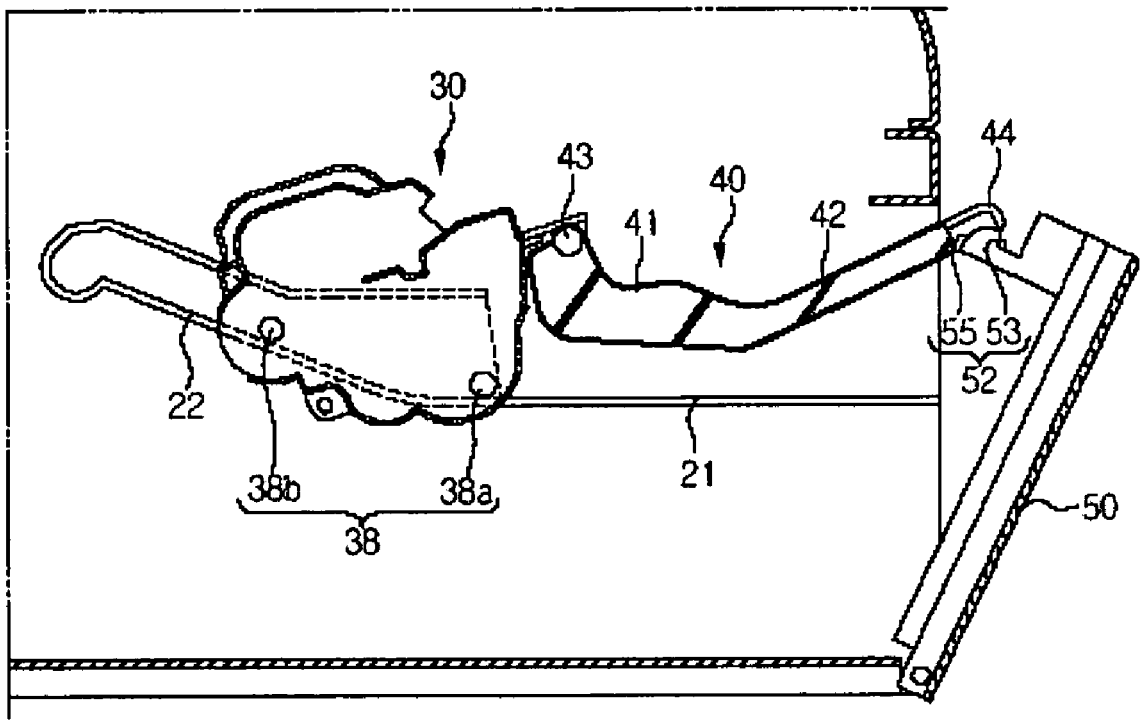
FIG. 5 is a partial side elevation of the image forming apparatus at a third position at which a cover is unlocked from a handle of the development cartridge.
Figure 6:
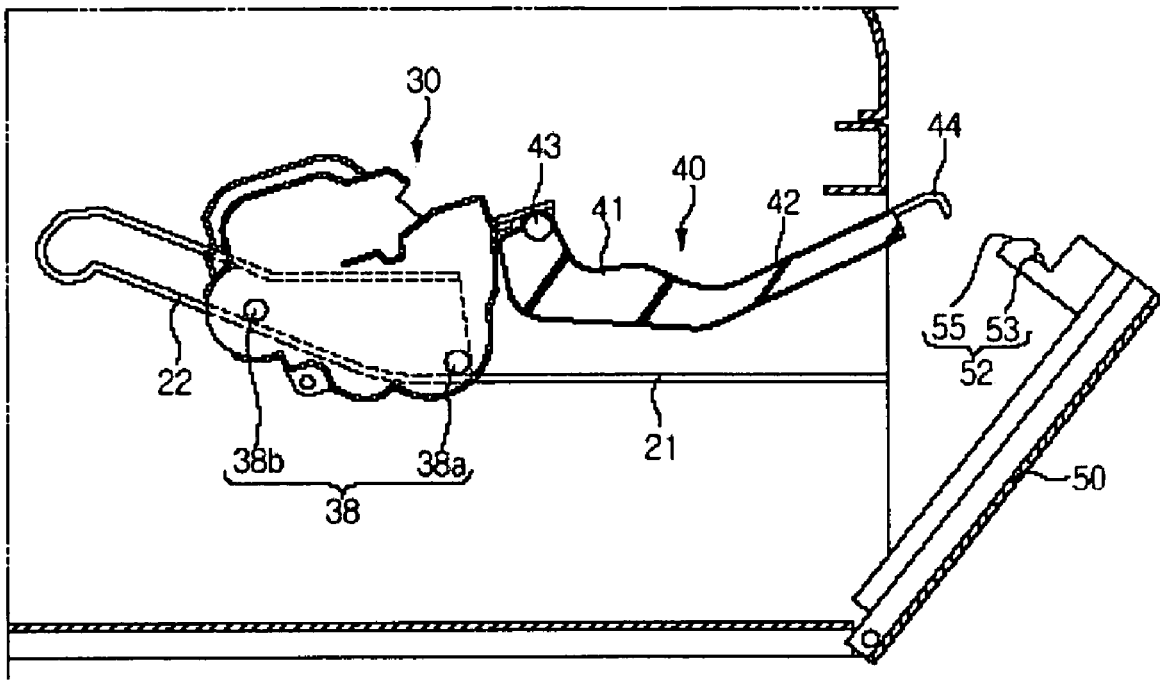
FIG. 6 is a partial side elevation of the image forming apparatus at a second position at which the cover is completely opened.

An operation that the development cartridge 30 is separated from the main body frame 10 will be described below. FIG. 4 shows a first position of the condition under which the cover is closed, FIG. 5 shows a third position at which the locking of the hook 44 of the handle 40 and the engagement jaw 52 of the cover 50 is released, and FIG. 6 shows a second position of the condition under which a cover is completely opened. As shown in FIG. 4, when the cover 50 is closed, the hook 44 of the handle 40 is locked to the engagement jaw 52 of the cover 50.

If a user opens the cover 50 to replace and repair the development cartridge 30, the handle 40 will be moved in a straight direction by the hook 44 locked to the engagement jaw 52 of the cover 50, and then the development cartridge 30 connected with the handle 40 will be also moved. Here, since the guide bosses 38 of the development cartridge 30 are moved along the slant portion 22 of the guide rail 20 formed within the main body frame 10, the development cartridge 30 is moved to slant downwardly.

If the cover 50 is further opened, the first guide boss 38*a* will pass over the slant portion 22 of the guide rail 20 and travel along the horizontal portion 21. Here, since the first guide boss 38*a* travels the horizontal portion 21, the slant rib 42, which straightly moves, of the handle 40 will perform an upward movement. That is, since the slant rib 42 is formed and slanted upwardly, if the first guide boss 38*a* of the guide bosses 38 travels along the horizontal portion 21, the slant rib 42 of the handle 40 will be raised.

Referring to FIG. 5, where the first guide boss 38*a* of the development cartridge 30 is moved along the horizontal portion 21 of the guide rail 20 at a predetermined distance, the slant rib 42, of the handle 40, will be moved and raised to a certain height in accordance with the movement. Consequently, the hook 44 will be also raised and will escape from the engagement jaw 52. Thus, the locking thereof is released. Thus, from the third position to the second position at which the cover 50 is completely opened as shown in FIG. 6, the engagement jaw 52 of the cover 50 and the hook 44 of the handle 40 will not influence each other.

When the hook 44 of the handle 40 escapes from the engagement jaw 52, a portion of the slant rib 42 of the handle 40 may be exposed to the outside of the main body frame 10. Thus, a user may take out the development cartridge 30 by gripping the slant rib 42 of the handle 40 exposed to the outside of the main body frame 10.

While the image forming apparatus including the paper moving path of the "C" shape is illustrated and described in the embodiment of the present invention, the present invention should not be limited to this embodiment. It will be readily understood that the present invention can be applied to such an image forming apparatus having a construction that the development cartridge is deeply mounted therein although the paper moving path has an "S" shaped configuration.

As is mentioned above, in the image forming apparatus according to aspects of the present invention, since the handle of the development cartridge is connected to the cover whereby the development cartridge is moved to the outside with relation to the opening operation of the cover, a user may easily separate the development cartridge from the image forming apparatus. Accordingly, there is an advantage that the convenience for the user is improved, and, particularly, the present invention is effective when the development cartridge is to be deeply mounted within the image forming apparatus.

Although a few embodiments of the present invention have been shown and described, it would be appreciated by those skilled in the art that changes may be made in these embodiments without departing from the principles and spirit of the invention, the scope of which is defined in the claims and their equivalents.

What is claimed is:

1. An image forming apparatus, comprising:

a main body frame;

a cover which is pivotally coupled to the main body frame, to occupy and move between a first position at which the cover is closed and a second position at which the cover is open; and a development cartridge, which is detachably mounted to an inner portion of the main body frame; and a handle connected to the cover so as to move the development cartridge in the outside direction of the main body frame when the cover is moved from the first position to the second position.

2. The image forming apparatus according to claim 1, further comprising a hinge coupling the cover to the main body frame.

3. The image forming apparatus according to claim 1, wherein the handle comprises:

a first end pivotally coupled to the development cartridge; and a second end, including a connection member, coupled to the cover.

4. The image forming apparatus according to claim 3, wherein the connecting member of the handle comprises a hook, wherein the cover comprises an engagement jaw to lock the hook.

5. The image forming apparatus according to claim 4, wherein the cover may occupy and move into a third position at which a locking of the hook of the handle with the engagement jaw is released, the third position being between the first position and the second position.

6. The image forming apparatus according to claim 5, wherein, when the cover is positioned at the third position, a portion of the handle of the development cartridge is exposed to the outside of the main body frame.

7. The image forming apparatus according to claim 6, wherein the handle comprises a horizontal rib of which one end is to be coupled with the development cartridge by a hinge axis thereof, and a slant rib, which is connected to the other end of the horizontal rib and which is formed to be slanted upwardly, having a hook at an end thereof, a portion of the slant rib being exposed to the outside of the main body frame.

8. The image forming apparatus according to claim 7, wherein the development cartridge comprises:

guide bosses, which project from both sides of the development cartridge; and a guide rail, to guide the guide bosses, formed in an inner portion of the main body frame.

9. The image forming apparatus according to claim 8, wherein the guide rail comprises a horizontal portion, and a slant portion, which is connected to the horizontal portion and which is slanted upwardly toward an inner portion of the main body frame, wherein the slant rib of the handle is moved upwardly from the point at which at least one of the guide bosses pass over the slant portion and travel the horizontal portion.

10. The image forming apparatus according to claim 9, wherein the third position, at which the locking of the hook of the handle and the engagement jaw is released, comprises a position at which at least one of the guide bosses travel along the horizontal portion of the guide rail at a predetermined distance.

11. The image forming apparatus according to claim 4, wherein the hook comprises:

a leading edge portion of a rounded shape, and wherein the engagement jaw has a slant surface which contacts with the leading edge portion and pushes the hook upwardly when the cover is moved from the first position to the second position; and a groove portion, in which the hook is situated when the cover is positioned at the first position.

12. An apparatus, including a main body frame into which a development cartridge may be detachably mounted, the apparatus comprising;

a cover which is pivotally coupled to the main body frame, to occupy and move between a first position at which the cover is closed and a second position at which the cover is open; and a handle connected to the cover and coupled to the development cartridge so as to move the development cartridge in an outside direction of the main body frame when the cover is moved from the first position to the second position.

13. The image forming apparatus according to claim 12, further comprising a hinge to couple the cover to the main body frame.

14. The image forming apparatus according to claim 12, wherein the handle comprises:

a first end pivotally coupled to the development cartridge; and a second end, including a connection member having a hook, wherein the cover comprises an engagement jaw to which hook may be locked.

15. The image forming apparatus according to claim 14, wherein the cover may occupy and move into a third position at which a locking of the hook of the handle with the engagement jaw is released, the third position being between the first position and the second position, wherein, when the cover is positioned at the third position, a portion of the handle of the development cartridge is exposed to the outside of the main body frame.

16. The image forming apparatus according to claim 15, wherein the handle comprises:

a horizontal rib of which one end is to be coupled with the development cartridge by a hinge axis thereof; and a slant rib, which is connected to the other end of the horizontal rib and which is formed to be slanted upwardly, the slant rib having a hook at an end thereof, wherein a portion of the slant rib is exposed to the outside of the main body frame.

17. The image forming apparatus according to claim 16, wherein the development cartridge comprises:

guide bosses, which project from both sides of the development cartridge; and a guide rail, to guide the guide bosses, formed in an inner portion of the main body frame.

18. The image forming apparatus according to claim 17, wherein the guide rail comprises:

a horizontal portion; and a slant portion, which is connected to the horizontal portion and which is slanted upwardly toward an inner portion of the main body frame, wherein the slant rib of the handle is moved upwardly from the point at which at least one of the guide bosses pass over the slant portion and travel the horizontal portion.

19. The image forming apparatus according to claim 18, wherein the third position, at which the locking of the hook of the handle and the engagement jaw is released, comprises a position at which at least one of the guide bosses travel along the horizontal portion of the guide rail at a predetermined distance.

20. The image forming apparatus according to claim 14, wherein the hook comprises:

a leading edge portion of a rounded shape, and wherein the engagement jaw has a slant surface which contacts with the leading edge portion and pushes the hook upwardly when the cover is moved from the first position to the second position; and a groove portion, in which the hook is situated when the cover is positioned at the first position.

21. A method of facilitating removing a development cartridge from a detachable mounting in a main body frame of an image forming apparatus, the method comprising:

moving a cover, which is pivotally coupled to the main body frame, from a first position at which the cover is closed to a second position at which the cover is open, wherein, a handle is connected to the cover and the handle is coupled to the development cartridge; and moving the development cartridge toward an outside of the main body frame in conjunction with the moving of the cover.

* * * * *